US010242616B2

(12) United States Patent
He et al.

(10) Patent No.: US 10,242,616 B2
(45) Date of Patent: Mar. 26, 2019

(54) PIXEL COMPENSATION CIRCUIT AND ACTIVE MATRIX ORGANIC LIGHT EMITTING DIODE DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Xiaoxiang He, Beijing (CN); Xiaojing Qi, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 0 days.

(21) Appl. No.: 15/519,037

(22) PCT Filed: Jul. 1, 2016

(86) PCT No.: PCT/CN2016/088118

§ 371 (c)(1),
(2) Date: Apr. 13, 2017

(87) PCT Pub. No.: WO2017/117932

PCT Pub. Date: Jul. 13, 2017

(65) Prior Publication Data

US 2017/0365215 A1 Dec. 21, 2017

(30) Foreign Application Priority Data

Jan. 4, 2016 (CN) ..... 2016 1 0003904

(51) Int. Cl.
*G09G 3/3233* (2016.01)
*G09G 3/20* (2006.01)
(Continued)

(52) U.S. Cl.
CPC ..... *G09G 3/3233* (2013.01); *G09G 3/20* (2013.01); *G09G 3/3225* (2013.01);
(Continued)

(58) Field of Classification Search
CPC ..... G09G 3/30; G09G 3/3225–3/3258; G09G 2300/0439; G09G 2300/08–2300/0823
See application file for complete search history.

(56) References Cited

U.S. PATENT DOCUMENTS

2005/0052365 A1 3/2005 Jang
2007/0242016 A1* 10/2007 Choi ..... G09G 3/3233 345/92

(Continued)

FOREIGN PATENT DOCUMENTS

CN 102222465 A 10/2011
CN 102411893 A 4/2012

(Continued)

OTHER PUBLICATIONS

International Search Report and Written Opinion dated Oct. 10, 2016; PCT/CN2016/088118.

(Continued)

*Primary Examiner* — David Tung
(74) *Attorney, Agent, or Firm* — Ladas & Parry LLP

(57) ABSTRACT

A pixel compensation circuit and an Active Matrix Organic Light Emitting Diode (AMOLED) display apparatus. The circuit includes a data signal writing module, a high voltage signal writing module, a first reference voltage generation module and a second reference voltage writing module; the data signal writing module and the high voltage signal writing module are connected with a first terminal of the capacitor; the first reference voltage generation module is connected with a second terminal of the capacitor and a drain of the driving transistor; a gate of the driving transistor is connected with the second terminal of the capacitor, the drain thereof is connected with an anode of the light emitting device, a source thereof is connected with the second reference voltage writing module, and connected with the (Continued)

high voltage signal writing module; a cathode of the light emitting device is connected with a common ground electrode.

17 Claims, 6 Drawing Sheets

(51) Int. Cl.
*G09G 3/3266* (2016.01)
*G09G 3/3225* (2016.01)
*G09G 3/3258* (2016.01)

(52) U.S. Cl.
CPC ..... *G09G 3/3258* (2013.01); *G09G 3/3266* (2013.01); *G09G 2300/0814* (2013.01); *G09G 2300/0819* (2013.01); *G09G 2300/0842* (2013.01)

(56) References Cited

U.S. PATENT DOCUMENTS

2008/0150847 A1 6/2008 Kim et al.
2009/0225009 A1 9/2009 Ka
2012/0235972 A1* 9/2012 Liu ..... G09G 3/3233 345/211
2013/0222440 A1 8/2013 Ikeda
2014/0160093 A1* 6/2014 Chaji ..... G09G 3/3291 345/204
2014/0333515 A1* 11/2014 In ..... G09G 3/3233 345/82
2014/0340377 A1 11/2014 Kishi et al.
2014/0353629 A1 12/2014 Jin
2015/0062193 A1 3/2015 Kanda et al.

FOREIGN PATENT DOCUMENTS

CN 103578416 A 2/2014
CN 203812535 A 9/2014
CN 104217675 A 12/2014
CN 104424892 A 3/2015
CN 105448244 A 3/2016
KR 100824854 B1 4/2008

OTHER PUBLICATIONS

The First Chinese Office Action dated Aug. 2, 2017; Appln. 201610003904.9.

* cited by examiner

PIXEL COMPENSATION CIRCUIT AND ACTIVE MATRIX ORGANIC LIGHT EMITTING DIODE DISPLAY APPARATUS

CROSS-REFERENCE TO RELATED APPLICATION

This application claims priority of Chinese Patent Application No. 201610003904.9 filed on Jan. 4, 2016 with the State Intellectual Property Office of China, the disclosure of which is incorporated herein by reference in its entirety.

TECHNICAL FIELD

The present disclosure relates to the field of display technical, and particularly to a pixel compensation circuit and an Active Matrix Organic Light Emitting Diode (AMOLED) display apparatus.

BACKGROUND

The flat panel display apparatus has many advantages such as thinness, power saving and radiation-free etc., and thus being used widely. The flat panel display apparatus in the related art primarily comprises Liquid Crystal Display (LCD) apparatus and Organic Light Emitting Diode (OLED) display apparatus.

The OLED display apparatus realizes displaying by self-luminance, and thus it needs no backlight, and has excellent characteristics such as high contrast, small thickness, wide view angle, rapid response, capable of being manufactured as a flexible display panel, wide range of operating temperature, and simple configuration and process, regarded as the next generation display apparatus which can displace the LCD.

OLED display apparatus can be classified into two categories, i.e., Passive Matrix OLED (PMOLED) display apparatus and AMOLED display apparatus, in terms of the driving mode, that is, Direct Addressing and Thin Film Transistor (TFT) Array Addressing. Thereinto, the PMOLED display apparatus is generally used as small-size display apparatus, since the power consumption of the PMOLED display apparatus is higher, which obstacles its application in large-size display apparatus. The AMOLED display apparatus is generally used as large-size display apparatus with high definition due to its high light-emitting efficiency.

FIG. 1 is a circuit diagram of a pixel circuit of an AMOLED display apparatus in the related art. In the display area of the AMOLED display apparatus, the pixels are arranged in a matrix form including a plurality of rows and a plurality of columns, and each pixel is generally driven using a pixel circuit constituted of two thin film transistors and one capacitor, that is, using the driving mode of 2T1C. Specifically, the gate of the first transistor T1 is electrically connected to the gate line Scan, the source is electrically connected to the data signal line DATA, and the drain is electrically connected with the gate of the second transistor T2 and one terminal of the capacitor C; the source of the second transistor T2 is electrically connected to the high voltage signal terminal VDD, and the drain is electrically connected to the anode of the organic light emitting diode D; the cathode of the organic light emitting diode D is electrically connected to the common ground electrode VSS; one terminal of the capacitor C is electrically connected to the drain of the first transistor T1, and the other terminal is electrically connected to the source of the second transistor T2. When displaying, the gate line Scan controls the first transistor T1 to be turned on, the data signal voltage of the data single line DATA is supplied to the gate of the second transistor T2 and the capacitor C through the first transistor T1, and then the first transistor T1 is turned off, and the gate voltage of the second transistor T2 can still continue maintaining the data signal voltage due to the effect of the capacitor C, such that the second transistor T2 is in the on-state, the driving current of the high voltage signal terminal VDD corresponding to the data signal voltage is supplied to the organic light emitting diode D through the second transistor T2, and the organic light emitting diode D is driven to emit light.

In the AMOLED display apparatus described above, the organic light emitting diode D is driven depending on the current generated by the second transistor T2 in the saturated state; and since the critical voltages of the second transistors T2 in respective pixels are not the same due to the nonuniformity in the TFT process, and since different extent of drift will occur in the threshold voltage Vth of the second transistor T2 during the light emission of the organic light emitting diode D, the brightness uniformity in respective pixel is poor when been driven with the above-mentioned 2T1C driving circuit, resulting in disadvantages such as the display nonuniformity and the like.

SUMMARY

In view of the above, the present disclosure provides a pixel compensation circuit and an AMOLED display apparatus, which can avoid the brightness of the light emitting device during the light emission from being changed and improve the brightness uniformity during the light emission.

In one aspect, the present disclosure provides a pixel compensation circuit comprising a data signal writing module, a high voltage signal writing module, a first reference voltage generation module, a second reference voltage writing module, a driving transistor, a capacitor and a light emitting device, wherein the data signal writing module is connected with a first terminal of the capacitor; the high voltage signal writing module is connected with the first terminal of the capacitor; the first reference voltage generation module is connected with a second terminal of the capacitor and a drain of the driving transistor; a gate of the driving transistor is connected with the second terminal of the capacitor, the drain is connected with an anode of the light emitting device, and a source is connected with the second reference voltage writing module and connected with the high voltage signal writing module; a cathode of the light emitting device is connected with a common ground electrode.

Optionally, the first reference voltage generation module is further connected with the anode of the light emitting device.

Optionally, the pixel compensation circuit further comprises a voltage eliminating module connected between the drain of the driving transistor and the anode of the light emitting device, for outputting a third reference voltage to the anode of the light emitting device.

Optionally, the data signal writing module comprises a data signal line and a first transistor; a control electrode of the first transistor is connected with a gate line, a source is connected with the data signal line, and a drain is connected with the first terminal of the capacitor.

Optionally, the high voltage signal writing module comprises a high voltage signal terminal, a second transistor and a third transistor; a control electrode of the second transistor is connected with a light emitting signal terminal, a source is connected with the high voltage signal terminal, and a drain is connected with a source of the third transistor and the source of the driving transistor; a control electrode of the third transistor is connected with the light emitting signal terminal, and a drain is connected with the first terminal of the capacitor.

Optionally, the second reference voltage writing module comprises a second reference voltage terminal and a fourth transistor; a control electrode of the fourth transistor is connected with the gate line, a source is connected with the second reference voltage terminal, and a drain is connected with the source of the driving transistor.

Optionally, the first reference voltage generation module comprises a reference current terminal, a fifth transistor and a sixth transistor; a control electrode of the fifth transistor is connected with the gate line, a source is connected with the reference current terminal, and a drain is connected with a source of the sixth transistor and the drain of the driving transistor; a control electrode of the sixth transistor is connected with the gate line, and a drain is connected with the second terminal of the capacitor.

Optionally, the first reference voltage generation module comprises a reference current terminal, a fifth transistor and a sixth transistor; a control electrode of the fifth transistor is connected with the gate line, a source is connected with the reference current terminal, and a drain is connected with a source of the sixth transistor, the anode of the light emitting device and the drain of the driving transistor; a control electrode of the sixth transistor is connected with the gate line, and a drain is connected with the second terminal of the capacitor.

Optionally, the voltage eliminating module comprises a third reference voltage signal terminal, a seventh transistor and an eighth transistor; a control electrode of the seventh transistor is connected with the light emitting terminal, a source is connected with the drain of the driving transistor, and a drain is connected with the anode of the light emitting device; a control electrode of the eighth transistor is connected with the gate line, a source is connected with the third reference voltage signal terminal, and a drain is connected with the anode of the light emitting device.

Optionally, the light emitting device is an OLED.

In another aspect, the present disclosure further provides an AMOLED display apparatus comprising the pixel compensation circuit.

The present disclosure has the following advantageous effects:

In the pixel compensation circuit provided in the present disclosure, at the pre-light-emitting period of the light emitting device, a voltage including the threshold voltage of the driving transistor is written to the second terminal of the capacitor and the gate of the driving transistor by the first reference voltage generation module; a voltage is written to the source of the driving transistor by the high voltage signal writing module; at the light emitting period of the light emitting device, the generated driving current is irrelevant to the threshold voltage of the driving transistor and the voltage of the high voltage signal terminal, such that the emission brightness of the light emitting device is not affected by the uniformity in the manufacturing process for the driving transistor, the drift in the threshold voltage thereof during the light emission and the voltage drop of the high voltage signal terminal, thereby it is possible to avoid the brightness of the light emitting device during the light emission from being changed and improve the brightness uniformity during the light emission. Furthermore, at the light emitting period of the light emitting device, the capacitor maintains a floating state, such that the voltage difference across both terminals thereof, that is, the voltage difference across the gate and the source of the driving transistor is maintained constant, therefore the driving current does not fluctuate due to the change in the high voltage signal terminal, thereby further avoiding the brightness of the light emitting device during the light emission from being changed and improving the brightness uniformity during the light emission.

The AMOLED display apparatus provided in the present disclosure can avoid the emission brightness of the light emitting device within each pixel in one frame from being changed and avoid nonuniformity in the emission brightness of the light emitting device within each pixel caused by the manufacturing process for the driving transistor within each pixel by using the pixel compensation circuit, thereby improving the display effect and the display uniformity.

BRIEF DESCRIPTION OF THE DRAWINGS

In order to explain the solutions in the embodiments of the present application more clearly, drawings required for describing an embodiment will be introduced briefly below. Obviously, the drawings described below are only some embodiments recorded in the present application, and those ordinary skilled in the art can obtain other drawings according to these drawings without any inventive labors. The following drawings are not intentionally depicted to scale in terms of actual sizes, with emphasis focus on the gist of the present application.

DETAILED DESCRIPTION

In order to explain the objects, solutions and advantages of the embodiments of the present disclosure more clearly, the solutions of the embodiments of the present disclosure will be described clearly and completely below in conjunction with drawings of the embodiments of the present disclosure. Obviously, the embodiments described are a part of the embodiments of the present disclosure, but not all the embodiments. Based on the embodiments of the present disclosure described, all other embodiments obtained by those ordinary skilled in the art belong to the scope protected by the present disclosure.

Unless otherwise defined, the technical terms or scientific terms used herein should be in the general meaning as understood by those of ordinary skill in the art to which this disclosure belongs. The words "first", "second" and the like used in the specification and claims of the present disclosure do not represent any order, amount or importance, but are merely used to distinguish different constituent parts. Likewise, the words "one" or "a" and the like do not represent a limitation in the amount, neither, but rather represent the presence of at least one. The words "connect" or "connect with" and the like are not limited to physical or mechanical connections, but may include electrical connections, whether direct or indirect. The "up", "down", "left", "right"

and the like are used only to represent the relative position relationship, which is changed accordingly after the absolute position of the described object is changed.

Figure 1:
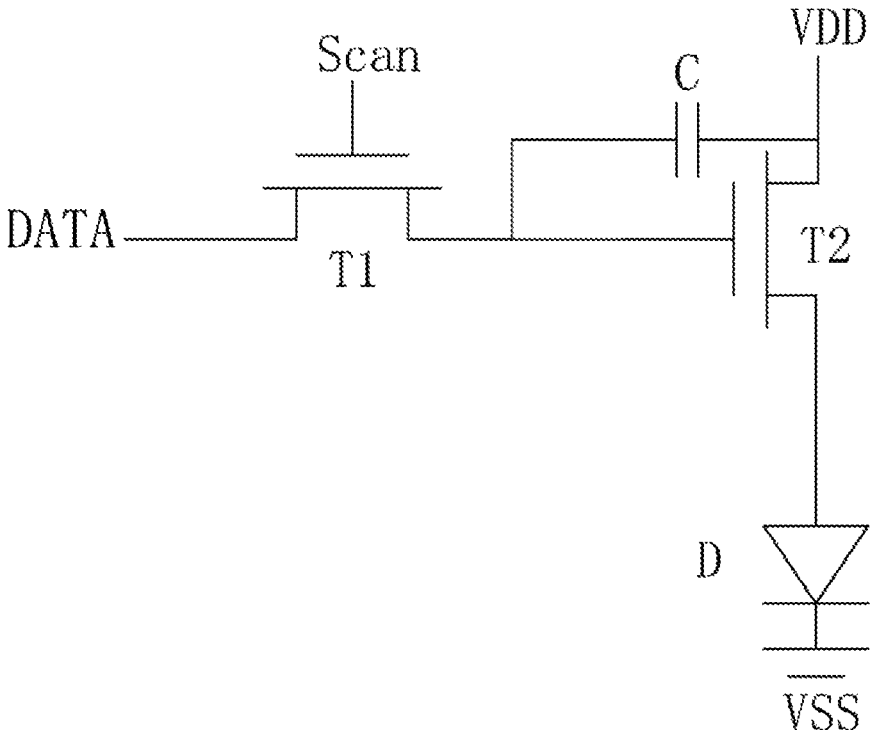
FIG. 1 is a circuit diagram of an AMOLED pixel circuit in the related art.
Figure 2:
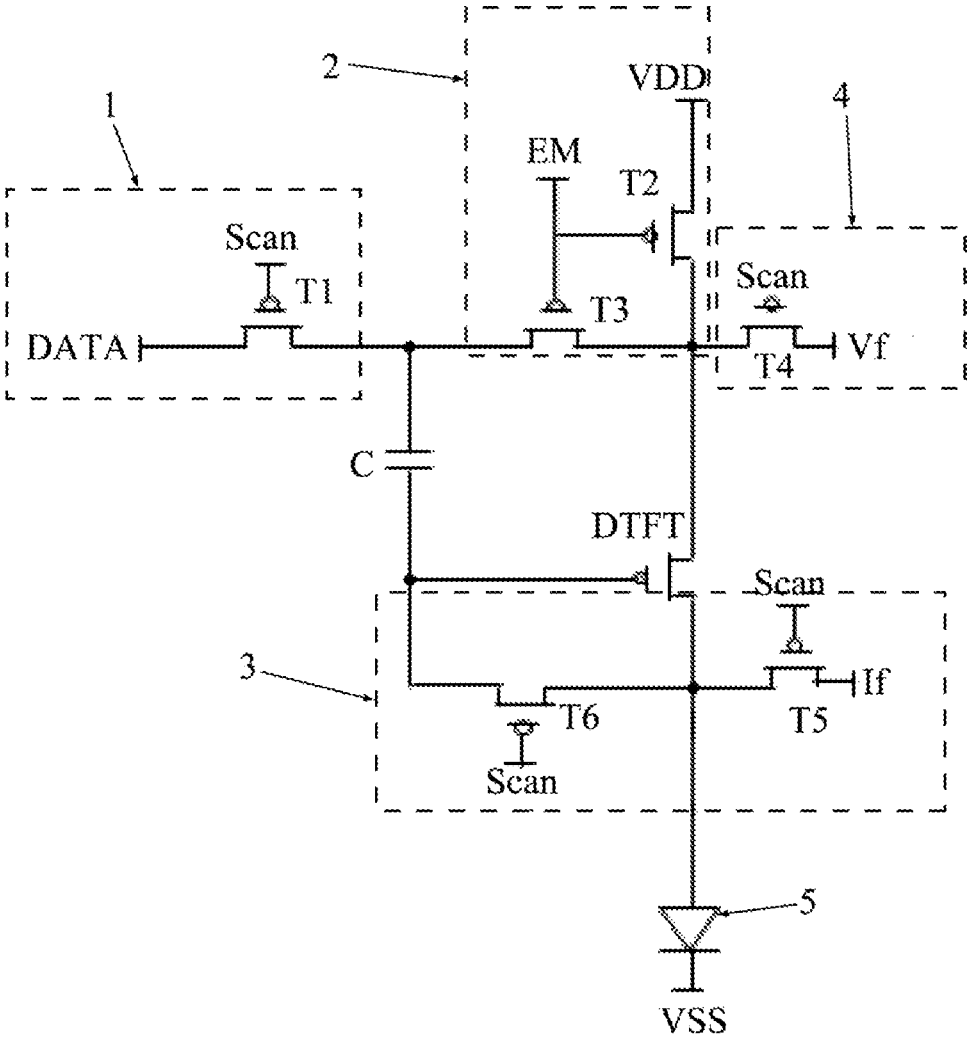
FIG. 2 is a circuit diagram of a pixel compensation circuit in some embodiments of the present disclosure.

The present disclosure provides a plurality of implementations of a pixel compensation circuit. FIG. 2 is a circuit diagram of a pixel compensation circuit in some embodiments of the present disclosure. As illustrated in FIG. 2, in the present implementation, the pixel compensation circuit comprises a data signal writing module 1, a high voltage signal writing module 2, a first reference voltage generation module 3, a second reference voltage writing module 4, a driving transistor DTFT, a capacitor C and a light emitting device 5. The data signal writing module 1 is connected with a first terminal of the capacitor C; the high voltage signal writing module 2 is connected with the first terminal of the capacitor C. The first reference voltage generation module 3 is connected with a second terminal of the capacitor C and a drain of the driving transistor DTFT. A gate of the driving transistor DTFT is connected with the second terminal of the capacitor C, and the drain is connected with an anode of the light emitting device 5; a source is connected with the second reference voltage writing module 4, and connected with the high voltage signal writing module 2. A cathode of the light emitting device 5 is connected with a common ground electrode VSS; the light emitting device 5 can specifically be an OLED.

Specifically, as illustrated in FIG. 2, the data signal writing module 1 comprises a data signal line DATA and a first transistor T1; a control electrode (i.e., a gate) of the first transistor T1 is connected with a gate line Scan, a source thereof is connected with the data signal line DATA, and a drain thereof is connected with the first terminal of the capacitor C. The high voltage signal writing module 2 comprises a high voltage signal terminal VDD, a second transistor T2 and a third transistor T3; a control electrode (i.e., a gate) of the second transistor T2 is connected with a light emitting signal terminal EM, a source thereof is connected with the high voltage signal terminal VDD, and a drain thereof is connected with a source of the third transistor T3 and the source of the driving transistor DTFT; a control electrode (i.e., a gate) of the third transistor T3 is connected with the light emitting signal terminal EM, and a drain thereof is connected with the first terminal of the capacitor C. The second reference voltage writing module 4 comprises a second reference voltage terminal Vf and a fourth transistor T4; a control electrode (i.e., a gate) of the fourth transistor T4 is connected with the gate line Scan, a source thereof is connected with the second reference voltage terminal Vf, and a drain thereof is connected with the source of the driving transistor DTFT. The first reference voltage generation module 3 comprises a reference current terminal If, a fifth transistor T5 and a sixth transistor T6; a control electrode (i.e., a gate) of the fifth transistor T5 is connected with the gate line Scan, a source thereof is connected with the reference current terminal If, and a drain thereof is connected with a source of the sixth transistor T6 and the drain of the driving transistor DTFT; a control electrode (i.e., a gate) of the sixth transistor T6 is connected with the gate line, and a drain thereof is connected with the second terminal of the capacitor C.

Figure 3:
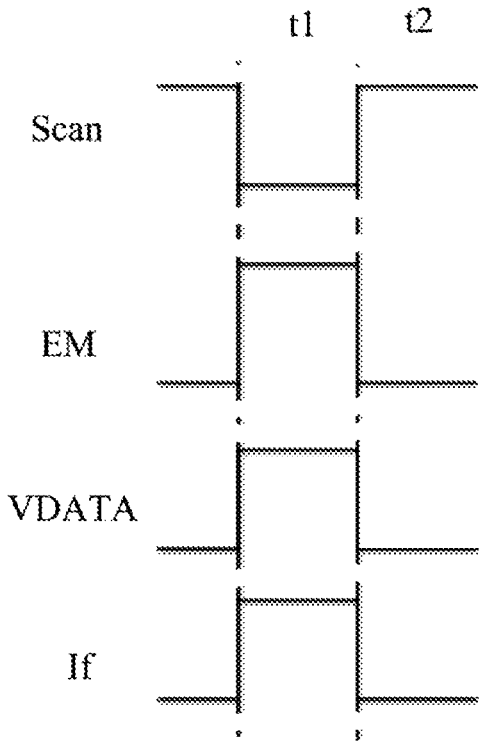
FIG. 3 is a timing diagram of each signal in the pixel compensation circuit illustrated in FIG. 2.

In the present implementation, the first transistor T1, the second transistor T2, the third transistor T3, the fourth transistor T4, the fifth transistor T5, the sixth transistor T6 and the driving transistor DTFT are P-type transistors; and in this case, the timings for each signal are illustrated in FIG. 3. The procedure of driving the light emitting device to emit light by the pixel compensation circuit illustrated in FIG. 2 will be described below in detail, in conjunction with the timings illustrated in FIG. 3.

Figure 4:
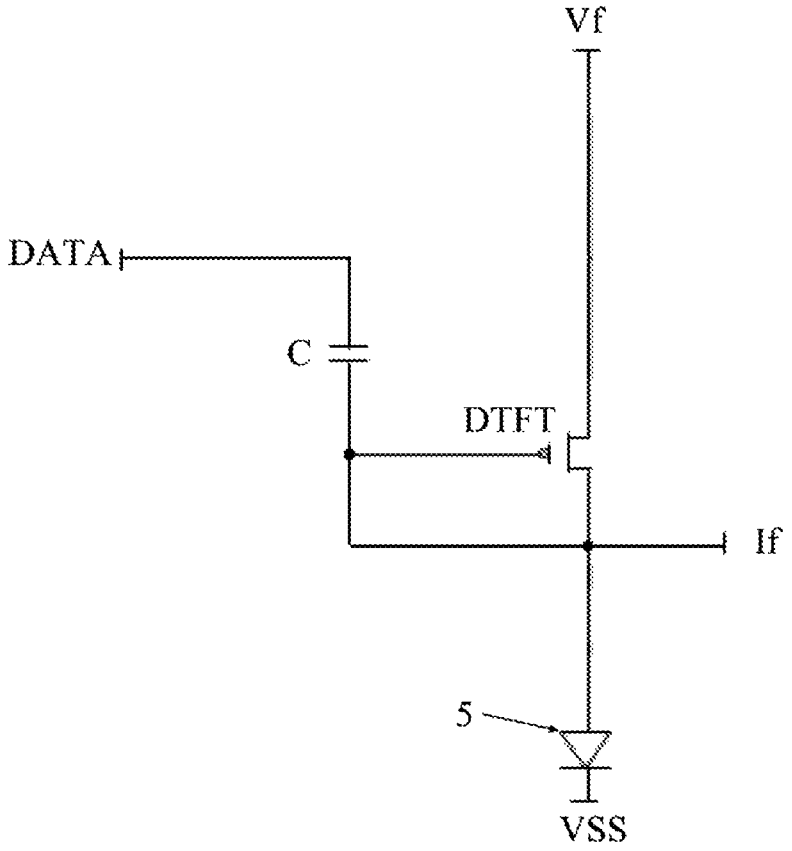
FIG. 4 is an equivalent circuit diagram for a t1 period.

At a first period t1, this period is a period in which the light emitting device 5 does not emit light; specifically, a scan signal output from the gate line Scan is at a low level, a light emitting signal output from the light emitting signal terminal EM is at a high level, and a data signal output from the data signal line DATA is at a high level. In this case, the first transistor T1 is turned on, the second transistor T2 and the third transistor T3 are turned off, the fourth transistor T4 is turned on, and the fifth transistor T5 and the sixth transistor T6 are turned on, a equivalent circuit diagram of which at this time is illustrated in FIG. 4. Referring to FIG. 4, the data signal line DATA is connected with the first terminal of the capacitor C, and inputs the data signal to the first terminal of the capacitor C, such that a voltage at the first terminal of the capacitor C is VDATA; simultaneously, the second reference voltage terminal Vf is connected with the source of the driving transistor DTFT, such that a voltage of the source of the driving transistor DTFT is equal to Vff.

The reference current terminal If is connected with the second terminal of the capacitor C, that is, connected with the gate of the driving transistor DTFT. The reference current terminal If has a reference current Iff, which is a set value. In the case where the reference current terminal If has the reference current Iff, the reference current Iff satisfies the following equation (1):

$$Iff=k(Vgs-Vth)^2 \tag{1}$$

wherein k represents a constant related to the driving transistor DTFT; Vth represents a threshold voltage of the driving transistor DTFT; Vgs represents a voltage difference across the gate and the source of the driving transistor DTFT, i.e., Vgs=Vg−Vs, wherein Vg represents a gate voltage of the driving transistor DTFT, and Vs represents a source voltage of the driving transistor DTFT.

While at the t1 period, the source voltage of the driving transistor DTFT is Vff, therefore the above equation (1) can be converted into the following equation (2):

$$Iff=k(Vg-Vff-Vth)^2 \tag{2}$$

According to the above equation (2), the gate voltage Vg of the driving transistor DTFT can be calculated by:

$$Vg=\sqrt{Iff/k}+Vff+Vth \tag{3}$$

The calculated voltage Vg represents the voltage of the gate of the driving transistor DTFT at the t1 period. i.e., the voltage written to the second terminal of the capacitor C by the reference current terminal If.

In practice, the magnitude of the voltage Vg, which is written to the second terminal of the capacitor C and is the voltage of the gate of the driving transistor DTFT, can be controlled by setting a value of the reference current Iff, such that the gate of the driving transistor DTFT maintains the required voltage at the t1 period.

According to the above, at the t1 period, the voltage difference Δs across both terminals of the capacitor C is:

$$\Delta s=Vg-V\mathrm{DATA}=\sqrt{Iff/k}+Vff+Vth-V\mathrm{DATA} \tag{4}$$

Figure 5:
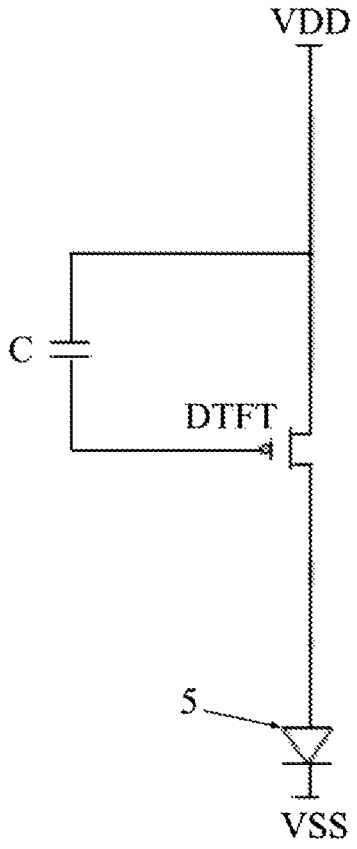
FIG. 5 is an equivalent circuit diagram for a t2 period.

At a second period t2, this period is a period in which the light emitting device 5 emits light; specifically, the scan signal output from the gate line Scan is at a high level, the light emitting signal output from the light emitting signal terminal EM is at a low level, and the data signal output from the data signal line DATA is at a low level. In this case, the first transistor T1 is turned off, the second transistor T2 and the third transistor T3 are turned on, the fourth transistor T4, the fifth transistor T5 and the sixth transistor T6 are turned off, the equivalent circuit diagram of which at this time is illustrated in FIG. 5. Referring to FIG. 5, the high voltage signal terminal VDD is connected with the first terminal of the capacitor C, and a voltage is written to the first terminal of the capacitor C, such that the voltage at the first terminal of the capacitor C is changed from VDATA to VDD; in addition, VDD is also connected with the source of the driving transistor DTFT at this period, and thus the voltage of the source of the driving transistor DTFT is changed from Vff into VDD. On the other hand, at the t2 period, the second terminal of the capacitor C is in a floating state, in which the voltage at the second terminal of the capacitor C can correspondingly change as the voltage at the first terminal of the capacitor C is changed from VDATA into VDD, so as to maintain the voltage across both terminals of the capacitor C constant, i.e., the voltage difference Δs across the both terminals of the capacitor C is still:

$$\Delta s=\sqrt{Iff/k}+Vff+Vth-VDATA \tag{4}$$

While the voltage at the first terminal of the capacitor C is equal to the voltage of the source of the driving transistor DTFr, and the voltage at the second terminal of the capacitor C is equal to the voltage of the gate of the driving transistor DTFT, therefore the voltage difference Vgs across the gate and the source of the driving transistor DTFT is equal to the value of the above Δs.

Hereto, the current generated depending on the driving transistor DTFT which is used for driving the light emitting device 5 at the t2 period can be obtained by:

$$\begin{aligned} I_{OLED} &= k(Vgs - Vth)^2 \\ &= k\left(\sqrt{Iff/k} + Vff + Vth - VDATA - Vth\right)^2 \\ &= k\left(\sqrt{Iff/k} + Vff - VDATA\right)^2 \end{aligned} \tag{5}$$

According to the equation (5), the current $I_{OLED}$ for driving the light emitting device 5 to emit light is irrelevant to the threshold voltage Vth of the driving transistor DTFT, and is also irrelevant to VDD. Therefore, the emission brightness of the light emitting device 5 is not affected by the uniformity in the manufacturing process for the driving transistor DTFT, the drift in the threshold voltage Vth thereof during the light emission, and the voltage drop (IR Drop) of VDD, and it is possible to avoid the brightness of the light emitting device 5 during the light emission being changed and improve the brightness uniformity during the light emission.

On the other hand, at the t2 period, since the capacitor C is in the floating state, the voltage difference Δs across both terminals of the capacitor C is constant when the voltage of the high voltage signal terminal VDD changes, i.e., the voltage difference Vgs across the gate and the source of the driving transistor DTFT is maintained constant, and thus, the generated driving current $I_{OLED}$ does not fluctuate due to the voltage change in VDD, so that it is possible to further ensure that the driving current $I_{OLED}$ is maintained stable, avoid the brightness of the light emitting device 5 during the light emission being changed and improve the uniformity during the light emission.

Optionally, the first reference voltage generation module 3 is also connected with the anode of the light emitting device 5. That is, as illustrated in FIG. 4, the drain of the fifth transistor T5 is also connected with the anode of the light emitting device 5 at the t1 period, and thus, the voltage Vg is also written to the anode of the light emitting device 5, eliminating the voltage maintained by the anode of the light emitting device 5 at the terminal of the previous frame, such that the emission brightness of the light emitting device 5 in the present frame is accurate without deviation.

Figure 6:
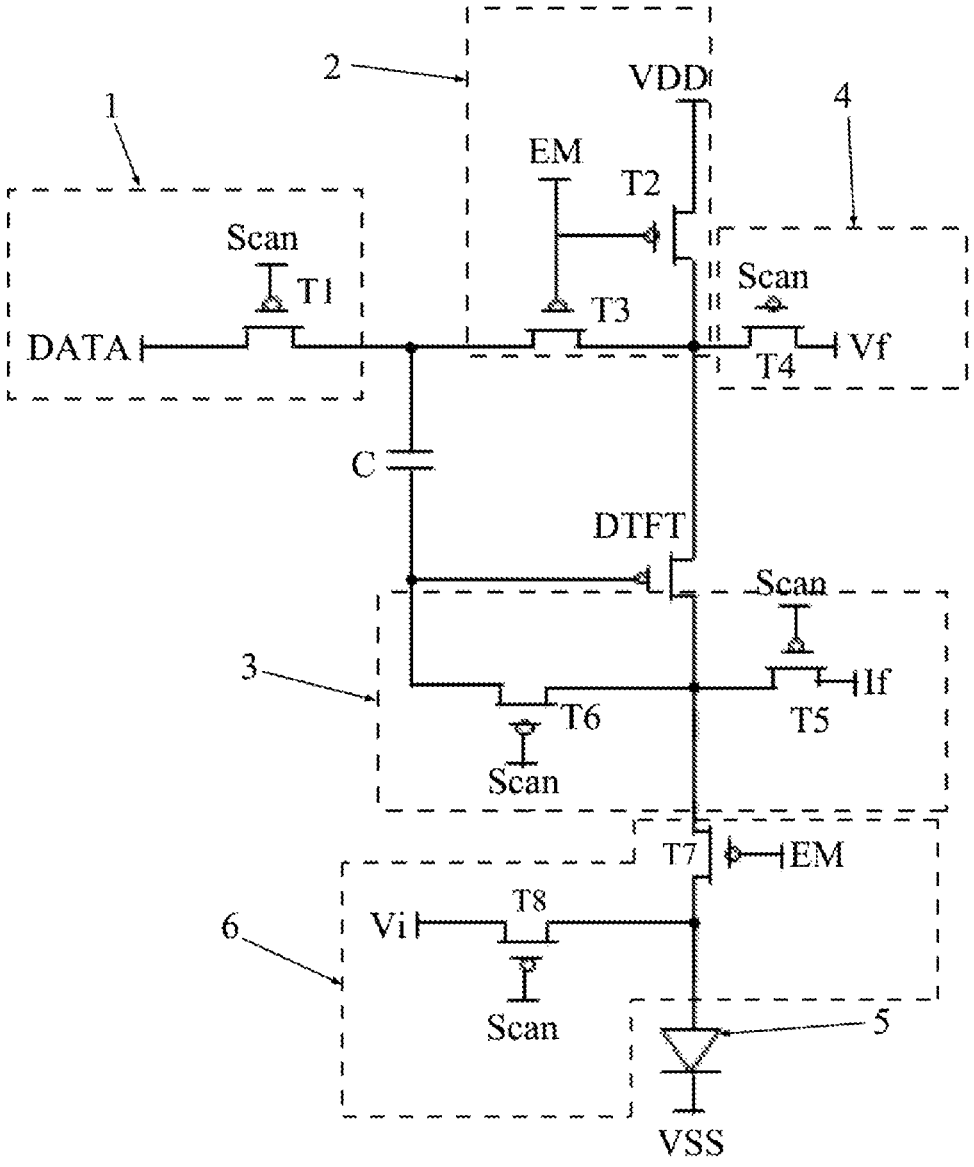
FIG. 6 is a circuit diagram of a pixel compensation circuit in some embodiments of the present disclosure.

FIG. 6 is a circuit diagram of the pixel compensation circuit in some embodiments of the present disclosure. As illustrated in FIG. 6, the difference from the implementation described above with reference to FIG. 2 is in that in the implementation illustrated in FIG. 6, the pixel compensation circuit further comprises a voltage eliminating module 6, which is connected between the drain of the driving transistor DTFT and the anode of the light emitting device 5, for inputting a third reference voltage Vi to the anode of the light emitting device 5.

Specifically, the voltage eliminating module 6 comprises a third reference voltage signal terminal Vi, a seventh transistor T7 and an eighth transistor T8; a control electrode of the seventh transistor T7 is connected with the light emitting signal terminal EM, a source thereof is connected with the drain of the driving transistor DTFT, and a drain thereof is connected with the anode of the light emitting device 5; a control electrode of the eighth transistor T8 is connected with the gate line Scan, a source thereof is connected with the third reference voltage signal terminal Vi, and a drain thereof is connected with the anode of the light emitting device 5.

In the present implementation, the timings for each signal are the same as those in the implementation described above with reference to FIG. 2. Specifically, at the t1 period, the seventh transistor T7 is turned off and the eighth transistor T8 is turned on. In this case, the driving transistor DTFT and the second terminal of the capacitor C are disconnected with the light emitting device 5, and the third reference voltage signal terminal Vi is connected with the anode of the light emitting device 5. Therefore, in the present implementation, the voltage input to the anode of the light emitting device 5 to eliminate the voltage of the anode of the light emitting device 5 in the previous frame is the third reference voltage Vi, rather than the voltage Vg in the implementation described above with reference to FIG. 2.

Compared with the implementation described above with reference to FIG. 2, in the present implementation, a separate voltage eliminating module 6 is used to eliminate the voltage of the anode of the light emitting device 5 at the t1 period, so as to secure the voltage difference Δs across both terminals of the capacitor C to satisfy the equation (4) as long as the first reference voltage generation module 3 writes a voltage to the second terminal of the capacitor C, without writing a voltage to the anode of the light emitting device 5. First of all, there is no need to consider to eliminate the voltage of the anode of the light emitting device 5 when determining the value of the reference current Iff, thereby it is possible to determine the value of the reference current Iff more easily; secondly, it is possible to control the voltage written to the anode of the light emitting device 5 by the voltage eliminating module 6 and the voltage written to the second terminal of the capacitor C by the first reference voltage generation module 3 independently, by which the control means is easier and the reliability is higher.

To sum up, in the pixel compensation circuit provided by some embodiments of the present disclosure, the generated driving current is irrelevant to the threshold voltage of the driving transistor DTFT and the high voltage signal terminal VDD at the light emitting period of the light emitting device 5 by writing a voltage, which comprises the threshold voltage Vth of the driving transistor DTFT, to the second terminal of the capacitor C and the gate of the driving transistor DTFT by the first reference voltage generation module 3 at the pre-light-emitting period of the light emitting device 5, such that the emission brightness of the light emitting device 5 is not affected by the uniformity in the manufacturing process for the driving transistor DTFT, the drift in the threshold voltage Vth thereof during the light emission and the voltage drop of the high voltage signal terminal VDD, thereby it is possible to avoid the brightness of the light emitting device 5 during the light emission from being changed and improve the brightness uniformity during the light emission. Furthermore, at the light emitting period of the light emitting device 5, the capacitor C maintains the floating state, such that the voltage difference across both terminals thereof, that is, the voltage difference across the gate and the source of the driving transistor DTFT, is maintained constant. Therefore, the driving current does not fluctuate due to the change in the high voltage signal terminal VDD, further avoiding the brightness of the light emitting device 5 during the light emission from being changed and improving the brightness uniformity during the light emission.

In some embodiments, the present disclosure further provides an AMOLED display apparatus which comprises the pixel compensation circuit described in some of the above embodiments.

The AMOLED display apparatus provided in the implementations of the present disclosure can avoid the emission brightness of the light emitting device within each pixel in one frame from being changed and avoid nonuniformity in the emission brightness of the light emitting device within each pixel caused by the manufacturing process for the driving transistor within each pixel by using the pixel compensation circuit provided in the above implementations of the present disclosure, thereby improving the display effect and the display uniformity.

It can be appreciated that the above implementations are only exemplary implementations used for explaining the principle of the present disclosure, while the present disclosure are not limited thereto. For those ordinary skill in the art, variations and modifications can be made without departing from the spirit and essential of the present disclosure, and such variations and modifications are deemed to be included within the protection scope of the present disclosure.

What is claimed is:

1. A pixel compensation circuit, comprising a data signal writing module, a high voltage signal writing module, a first reference voltage generation module, a second reference voltage writing module, a driving transistor, a capacitor and a light emitting device, wherein the data signal writing module is connected with a gate line and a first terminal of the capacitor; the high voltage signal writing module is connected with the first terminal of the capacitor and a source of the driving transistor;

the first reference voltage generation module is connected with a reference current terminal, a second terminal of the capacitor and a drain of the driving transistor;

the second reference voltage writing module is connected with the gate line and a source of the driving transistor;

a gate of the driving transistor is connected with a second terminal of the capacitor, the drain of the driving transistor is connected with an anode of the light emitting device; and a cathode of the light emitting device is connected with a common ground electrode, wherein the first reference voltage generation module comprises a fifth transistor and a sixth transistor; a control electrode of the fifth transistor is connected with the gate line, a source of the fifth transistor is connected with the reference current terminal, and a drain of the fifth transistor is connected with a source of the sixth transistor and the drain of the driving transistor; a control electrode of the sixth transistor is connected with the gate line, and a drain of the sixth transistor is connected with the second terminal of the capacitor.

2. The pixel compensation circuit of claim 1, wherein the first reference voltage generation module is further connected with the anode of the light emitting device.

3. The pixel compensation circuit of claim 2, wherein a drain of the fifth transistor is connected with a source of the sixth transistor, the anode of the light emitting device and the drain of the driving transistor.

4. The pixel compensation circuit of claim 2, wherein the data signal writing module comprises a data signal line and a first transistor; a control electrode of the first transistor is connected with the gate line, a source of the first transistor is connected with the data signal line, and a drain of the first transistor is connected with the first terminal of the capacitor.

5. The pixel compensation circuit of claim 2, wherein the high voltage signal writing module comprises a high voltage signal terminal, a second transistor and a third transistor; a control electrode of the second transistor is connected with a light emitting signal terminal, a source of the second transistor is connected with the high voltage signal terminal, and a drain of the second transistor is connected with a source of the third transistor and the source of the driving transistor; a control electrode of the third transistor is connected with the light emitting signal terminal, and a drain of the third transistor is connected with the first terminal of the capacitor.

6. The pixel compensation circuit of claim 1, wherein the pixel compensation circuit further comprises a voltage eliminating module connected between the drain of the driving transistor and the anode of the light emitting device, configured to output a third reference voltage to the anode of the light emitting device.

7. The pixel compensation circuit of claim 6, wherein the voltage eliminating module comprises a third reference voltage signal terminal, a seventh transistor and an eighth transistor; a control electrode of the seventh transistor is connected with a light emitting terminal, a source of the seventh transistor is connected with the drain of the driving transistor, and a drain of the seventh transistor is connected with the anode of the light emitting device; a control electrode of the eighth transistor is connected with the gate line, a source of the eighth transistor is connected with the third reference voltage signal terminal, and a drain of the eighth transistor is connected with the anode of the light emitting device.

8. The pixel compensation circuit of claim 6, wherein the data signal writing module comprises a data signal line and a first transistor; a control electrode of the first transistor is connected with the gate line, a source of the first transistor is connected with the data signal line, and a drain of the first transistor is connected with the first terminal of the capacitor.

9. The pixel compensation circuit of claim 6, wherein the high voltage signal writing module comprises a high voltage signal terminal, a second transistor and a third transistor; a control electrode of the second transistor is connected with a light emitting signal terminal, a source of the second transistor is connected with the high voltage signal terminal, and a drain of the second transistor is connected with a source of the third transistor and the source of the driving transistor; a control electrode of the third transistor is connected with the light emitting signal terminal, and a drain of the third transistor is connected with the first terminal of the capacitor.

10. The pixel compensation circuit of claim 6, wherein the first reference voltage generation module comprises a fifth transistor and a sixth transistor; a control electrode of the fifth transistor is connected with the gate line, a source of the fifth transistor is connected with the reference current terminal, and a drain of the fifth transistor is connected with a source of the sixth transistor and the drain of the driving transistor; a control electrode of the sixth transistor is connected with the gate line, and a drain of the sixth transistor is connected with the second terminal of the capacitor.

11. The pixel compensation circuit of claim 1, wherein the data signal writing module comprises a data signal line and a first transistor; a control electrode of the first transistor is connected with the gate line, a source of the first transistor is connected with the data signal line, and a drain of the first transistor is connected with the first terminal of the capacitor.

12. The pixel compensation circuit of claim 1, wherein the high voltage signal writing module comprises a high voltage signal terminal, a second transistor and a third transistor; a control electrode of the second transistor is connected with a light emitting signal terminal, a source of the second transistor is connected with the high voltage signal terminal, and a drain of the second transistor is connected with a source of the third transistor and the source of the driving transistor; a control electrode of the third transistor is connected with the light emitting signal terminal, and a drain of the third transistor is connected with the first end of the capacitor.

13. The pixel compensation circuit of claim 12, wherein the second reference voltage writing module comprises a second reference voltage terminal and a fourth transistor; a control electrode of the fourth transistor is connected with the gate line, a source of the fourth transistor is connected with the second reference voltage terminal, and a drain of the fourth transistor is connected with the source of the driving transistor.

14. The pixel compensation circuit of claim 1, wherein the light emitting device is an organic light emitting diode (OLED).

15. An active matrix organic light emitting diode (AMOLED) display apparatus, comprising the pixel compensation circuit of claim 1.

16. The active matrix organic light emitting diode (AMOLED) display apparatus of claim 15, wherein the first reference voltage generation module is further connected with the anode of the light emitting device.

17. The active matrix organic light emitting diode (AMOLED) display apparatus of claim 15, wherein the pixel compensation circuit further comprises a voltage eliminating module connected between the drain of the driving transistor and the anode of the light emitting device, configured to output a third reference voltage to the anode of the light emitting device.

* * * * *